United States Patent [19]

Stilling

[11] Patent Number: 4,554,754

[45] Date of Patent: Nov. 26, 1985

[54] SIGN WITH FLEXIBLE FACE

[76] Inventor: Johann Stilling, Apt. #A1001, 1141 Royal York Rd., Islington, Ontario, Canada

[21] Appl. No.: 628,222

[22] Filed: Jul. 6, 1984

[51] Int. Cl.[4] ..... G09F 17/00

[52] U.S. Cl. ..... 40/603

[58] Field of Search ..... 40/603, 604; 160/380, 160/382, 383, 387, 391, 392, 394, 395, 399, 403; 38/102.1, 102.3, 102.91

[56] References Cited

U.S. PATENT DOCUMENTS

| | | | |
|---|---|---|---|
| 4,041,861 | 8/1977 | Alter | 40/603 |
| 4,265,039 | 5/1981 | Brooks | 160/395 |
| 4,452,000 | 6/1984 | Gandy | 40/603 |

*Primary Examiner*—Robert P. Swiatek

*Assistant Examiner*—Cary E. Stone

*Attorney, Agent, or Firm*—George A. Rolston

[57] ABSTRACT

A face frame for a flexible sign panel the frame having four side members arranged in a generally rectangular shape, each side member having outer walls forming a partial enclosure, channel walls located within the enclosure provided by the outer walls defining a channel having an axis directed with a vector lying from the rear to the front of said frame and a channel opening, a bearing wall adjacent the channel opening, tensioning clamps to grip the edge of the flexible panel, the tensioning clamps fitting within the channel walls so that the clamps may be slid into and out of the channel walls, and, adjustment screws extending from the bearing wall to engage portions of the tensioning clamps for forcing the clamps into the channel to tension the flexible sign panel.

11 Claims, 3 Drawing Figures

SIGN WITH FLEXIBLE FACE

The invention relates to a sign, typically of the type of rectangular sign used on the store front of retail or commercial premises, in which such a sign has a flexible vinyl face printed with a business name, message or the like.

Sign faces made of rigid plastics, typically acrylic plastics materials are being replaced by signs made of a flexible vinyl coated fabric. Typically a form of woven polyester material, is coated with a thermo plastic such as vinyl plastic or the like.

Such flexible sign faces have many advantages. They are much lower in cost of material, and are easier to print. The fabric exhibits a very considerable useful working life, and is highly resistant to damage due to wind, weather and the like.

In addition, such flexible fabric sign faces are suitable both for use on illuminated signs, i.e. signs in which there is a sign box or housing containing a source of illumination located behind the fabric sign face, and also for signs of the type which are not illuminated, other than by surrounding daylight or artificial lights located in the surrounding area.

One of the obvious problems associated with using a flexible material for the sign face is that it is desirable to hold it as stiff and flat as possible, similar to the skin of a drum. Various different tensioning systems have been proposed. One such system is shown in U.S. Pat. No. 4,265,039

All such systems are directed to signs having a generally rectangular frame around the sign face wound, which may or may not be swingably or removably attached to a sign box or housing containing lighting tubes or the like. In many cases the tensioning frames for holding the sign faces were formed in two parts. The fabric was attached to and tensioned around a first part of the frame, and a second cover portion of the frame was then applied around the exterior. This was somewhat unsatisfactory since after prolonged weathering the fastening of the one frame portion to the other becomes weathered, and it is difficult to remove the fastenings, if it is desired to replace the flexible fabric. In addition, if the fabric stretches and becomes loose, then it is also necessary to dismantle the two frame portions to have access to the tensioning mechanism. Most designs are similar to the drumhead and skin. The face is drawn tight over a shoulder or rim. Usually the face material is drawn tight in a rearward direction, away from the rim towards the back of the frame.

This leads to mechanical problems.

It also makes it difficult to seal around the front surface of the face. Usually a gap is exposed at this point. Water, dirt, etc., can enter and cause damage.

Also, the edge of the rim represents the point of weakness of the face material.

In addition, however, in many cases the tensioning mechanism as proposed was based on some form of rod device around which the fabric could be wound up until it was tight. Since the fabric around the edge of the face may not always be cut precisely straight, the winding of the fabric edge onto a winding core or rod presents considerable difficulty. Any inaccuracy in the cutting of the fabric edge will also result in an uneven tension being applied to the fabric as a whole.

In some cases it was proposed to use relatively short lengths of tensioning device. However, in this case lengths of fabric between the tensioning devices would be left untensioned.

For all of these reasons therefore it was somewhat unsatisfactory to use rotary tensioning devices and it was also unsatisfactory to use two part frame constructions.

Clearly, it is advantageous if the frame can be formed as a single component, preferably by extrusion of metal such as aluminum. In addition, it is highly desirable to provide a tensioning system which does not depend on the winding of the fabric around a tensioning rod. Instead, it is preferable if the tensioning system is based on some form of clamp which holds the fabric all the way along its edge, and the clamp device can then simply be tightened up without winding.

BRIEF SUMMARY OF THE INVENTION

With a view to overcoming the disadvantages as described above, and the invention comprises a face frame for a flexible sign panel, the face frame comprising outer walls forming a partial enclosure, and inner channel walls located within the enclosure provided by said outer wall defining a channel having an open mouth directed inwardly and rearwardly with respect to the face frame, said channel extending from said open mouth in a direction outwardly and forwardly with respect to said frame, shoulder wall means adjacent said channel open mouth, on the forwardly located side thereof, a tension bearing wall adjacent the rearwardly directed side of said channel open mouth, a tensioning clamp by means of which the edge of said panel may be gripped, the clamp being dimensioned to be slidable within said channel so that it may be slid into and out of said channel, and, threaded adjustment means extending from said bearing wall and adapted to engage a portion of said clamping means, adjustment of said threaded means forcing said clamp into said channel, whereby to tension said sign panel around said shoulder.

More particularly, it is an objective of the invention to provide a face frame having the foregoing advantages wherein the frame outer walls define a generally L-shaped angle, enclosing an interior space, and wherein said inner walls forming said channel are directed at an angle towards the apex of the junction of said L-shaped walls, and including a tension bearing wall member extending from a point adjacent the free edge of one of said channel walls, for supporting said threaded adjustment means and a shoulder wall extending from the other one of said channel walls around which said panel may be drawn.

More particularly, it is an objective of the invention to provide a face frame having the foregoing advantages, and further incorporating a rear inner wall extending from one edge of one of said outer walls downwardly and inwardly, and further including a hinge wall extending rearwardly from said inner wall, for interengagement with a hinge portion of an adjacent housing.

Preferably, in accordance with the invention, the entire structure of the face frame will be fabricated as a unitary extrusion, having a common uniform cross-section on all four sides of the frame, and having a uniform tensioning devices on all four sides, whereby tension of the sign can be equalized.

The various features of novelty which characterize the invention are pointed out with particularity n in the claims annexed to and forming a part of this disclosure. For a better understanding of the invention, its operating advantages and specific objects attained by its use, reference shoud be had to the accompanying drawings and descriptive matter in which there are illustrated and described preferred embodiments of the invention.

IN THE DRAWINGS

DESCRIPTION OF A SPECIFIC EMBODIMENT

Figure 1:
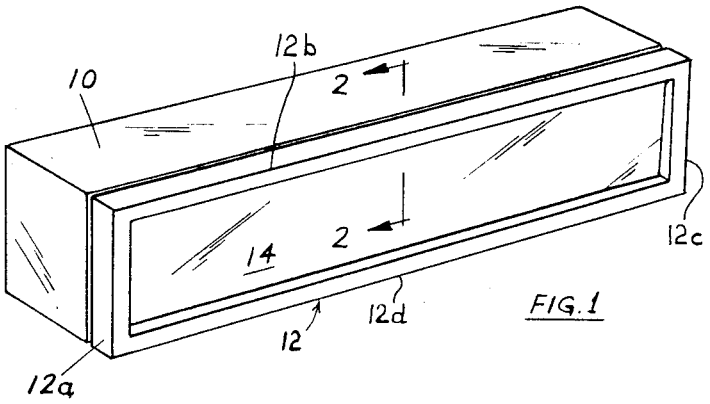
FIG. 1 is a front perspective illustration of a typical sign according to the invention.

As shown in FIG. 1, a typical sign such as that shown will be used in places such as the store front of a retail or commercial establishment. The sign may either be illuminated from within, i.e. it may contain lighting tubes, or illuminating the sign face from the rear. Alternatively, lighting may be provided around the exterior for lighting the signs in the front.

Such signs may also be used indoors, for example in large commercial buildings, in institutions, shopping plazas, and governmental buildings and the like.

As shown in FIG. 1, the sign comprises generally a rectangular housing 10 which will usually contain lighting tubes, and which is usually permanently fastened in position. The details of such sign housings are well known in the art and require no further description.

A sign frame or face frame 12 is attached to the front of the housing 10, and carries within it the flexible panel sign face 14. Any suitable or desired information may be printed or painted or otherwise shown on the panel 14.

Typically, the face frame has four side members arranged in a rectangular, or square shape and is hinged along its upper edge to the housing, and is fastened by screws or the like along the lower edge. In this way, when servicing is required for example, tensioning the sign face, or replacing the lighting tubes, the lower fastenings are removed, and the sign face can simply be swung upwardly away from the housing.

In other cases, however, the frame may be fastened permanently to the housing, or may be attached in some other way other than by hinges. Alternatively, in some other cases the frame may be used independently of housing, where for example, lighting is provided from the exterior.

Figure 2:
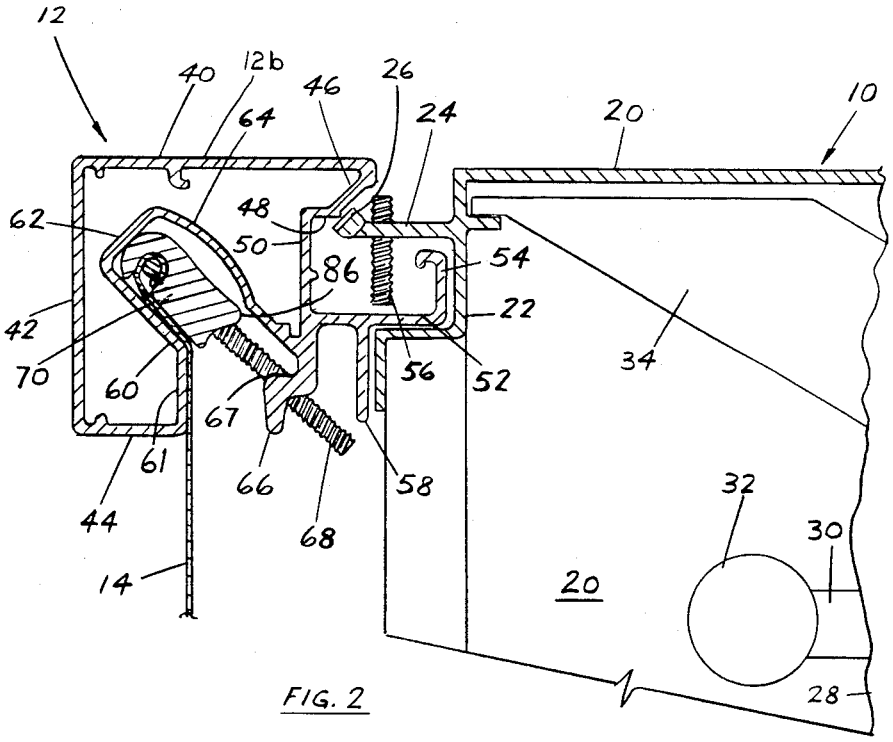
FIG. 2 is a section along the line 2—2 of FIG. 1.
Figure 3:
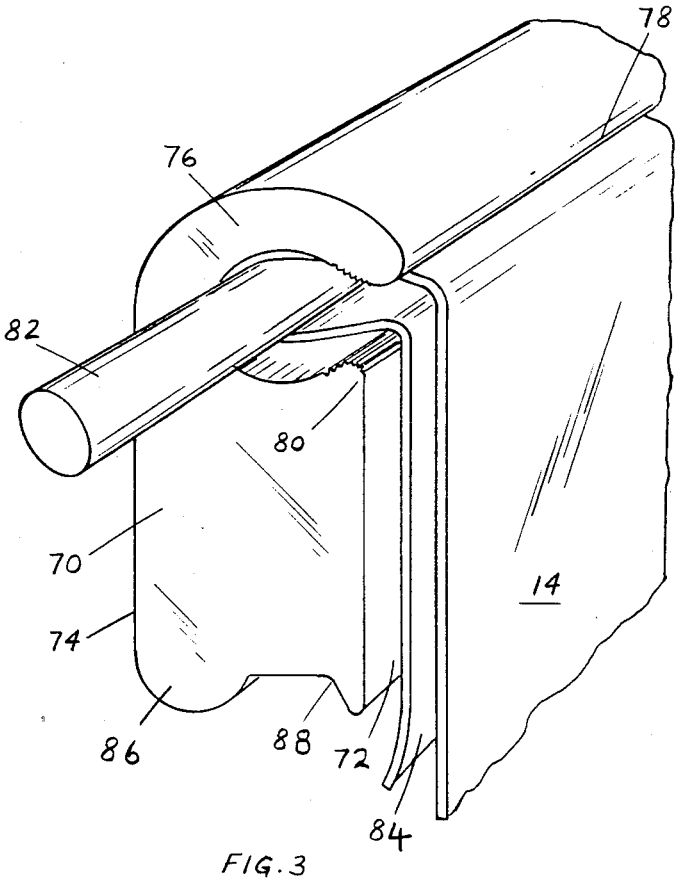
FIG. 3 is an enlarged perspective detail partially cut-a-way showing the clamping device and tensioning means spaced there along.

As best shown in FIGS. 2 and 3, the housing 10 will be seen to comprise a housing wall panel 20, which extends around the top, bottom and sides of the housing and is provided with a hinging formation 22 around its open front edge, and a sealing flange 24, having a resilient seal member 26 at the end thereof.

Within the housing 20 there are provided electrical raceways 28, carrying lighting receptacles 30 which in turn carry tubes 32.

The upper and lower walls 20 are preferably braced by means such as the diagonal bracing members 34.

As mentioned these details are essentially well known in the art and require no further description.

The face frame has side members 12*a, b, c, d,* and each side member will be seen to comprise an upper outer wall 40, a front outer wall 42, and a lower outer wall 44. The walls 40, 42, 44, together provided a generally three sided enclosure for a space enclosed therewithin. Extending along the rearward edge of upper wall 40, there is a downwardly inwardly formed sealing wall 46 having a sealing rib 48 formed thereon, oriented to engage with seal 26.

A downwardly dependent intermediate wall 50 extends downwardly from sealing wall 46, and a rearward hinge member 52 extends rearwardly from wall 50, ending in a hook portion 54. Walls 52 and 54 are shaped to meet with hinge formation 22 of housing 20.

Preferably, a plurality of hinge retaining screws 56 are passed through the sealing wall 24, so as to secure the hinge formation in position.

A downwardly dependent stop wall 58 extends from hinge wall 52, to provide a positive stop.

In accordance with the invention, a tensioning channel is provided by means of a generally three sided U-shaped channel wall formation comprising front channel wall 60, shoulder wall 61, bottom channel wall 62 and rear channel wall 64, all of which are formed integrally. Front channel wall 60 is formed integrally with shoulder wall 61 and lower outer wall 44, and defines a generally obtuse angle, for purposes to be described.

Bottom channel wall 62 defines the limits of the channel, and upper rear channel wall 64 is formed in a generally gently concave shape, and is joined to the junction of junction wall 50 and hinge wall 52.

An angled tension bearing wall 66 is also formed at the same junction, and extends downwardly and partially across the open mouth of the channel to ridge 67.

Tension bearing wall 66 is preferably provided with tapped drillings at intervals therealong to receive threaded adjustment screws 68.

In order to clamp the edge of the panel of flexible fabric, a fabric clamping member 70 is provided as shown in more detail in FIG. 3.

The clamp 70 will be seen to comprise a generally solid body portion of regular shape along its length and having parallel spaced apart front and rear faces 72 and 74. At one end (viewed in section), the body member 70 is provided with a generally arcuate wall 76 extending in a generally hook shaped fashion when viewed in section. The free end or edge 78 of wall 76 defines one side of an open mouth. The other side of the open mouth is defined by a radiussed curved edge portion 80 at the upper end of face 72.

A clamping rod 82 is shaped to be loosely received within the channel like space defined by wall 76, but is too large to pass out of the open mouth defined between edges 78 and 80.

The edge portion 84 of the flexible panel 14 is passed around the clamping rod 82, and is drawn back down adjacent the face 72 of the body 70, as shown in cut-a-away form in FIG. 3.

At the opposite end of the body 70, there is provided a generally large radius abutment rib 86, extending from the lower edge of the face 74, and adjacent the lower edge of the face 72, there is provided a generally angled retaining rib 88.

Edges 78 and 80 may be grooved or ridged to increase the grip on panel 14.

In operation, the face frame 12 is of course completely removed from the housing 10, for the installation of the flexible face panel 14 in the majority of cases.

The edge portion 84 may be slid around the clamping rod 82 which has already been placed within the interior of the channel defined by the curved wall 76.

Alternatively, a loop of the edge portion 84 can be inserted into the channel, and the clamping rod 82 can then be inserted into the loop and slid lengthwise.

In either case, the clamping member 70 is then pushed upwardly between the wall 60 and the bearing walls 66 into the channel defined by the walls 60, 62, and 64. The concave curvature of the wall 64 facilitates this insertion, since it will be apparent that the clamping member 70 must first of all be inserted more or less directly parallel to the front wall 42 and therefore at an angle to the axis of the channel.

During this insertion the panel 14 is located around shoulder wall 61 and between the wall 60 and the clamping member 70.

As the clamping member 70 is fully inserted into the channel, the rounded abutment rib 86 may be slid over the ridge 67 on the bearing wall 66, and will thus be retained in position.

The same operations may be repeated around all four sides of the panel 14 and frame 12.

During this operation the threaded tensioning devices may have been removed altogether, or preferably will simply have been backed off until they are only just catching on the threads in which they are received.

Once all four sides have been completely assembled in the manner described, the threaded tensioning devices 68 may then gradually be tightened up on all four sides. As will be apparent from FIG. 2, the operation of the threaded tensioning devices 68 will cause such devices to enter into contact with the lower end of the clamping members 70, and they will be received between the rounded shoulders 86 and the retaining rib 88. Further threading of the members 68 will force the clamping members 70 progressively along the outward and forward axis of their respective channel, thereby tensioning the panel 14.

It will be understood that prior to the operation of the threaded tensioning devices 68, the tension in the panel 14 may be more or less equalized manually by simply tugging on the free edge 84 along all four sides until the panel 14 is smooth and evenly tensioned.

This tugging action will also have the effect of pulling the clamping rods 82 towards the mouth of the channel defined by the wall 76, and this will then pinch the fabric 14, preventing it from slipping around the clamping rod 82.

When sufficient tension has been applied all the way along the tensioning members, it will be seen that the fabric of the panel 14 will be stretched around shoulder 61 and adjacent the wall 60, in a manner in which it is not engaging any sharp or extreme angles, and such tension can be adjusted or increased gradually during the life of the sign if desired. This will also effect a pressured seal between panel 14 and shoulder 61 and wall 60, such as will prevent entry of moisture, dirt, etc., in most circumstances.

As mentioned in the typical case the frame 12 will be attached to the housing 10 by the hinge formations 52 and 54 and the threaded retaining devices 56.

Similar retaining devices may be used along the lower edge of the frame (not shown) to secure the frame 12 in position.

However, in alternate situations other forms of attachment can be used, and conceivably the frame 12 can be used without the housing 10 at all if that should be required.

Various modifications could be made. For example, the channel could simply be two walls, open both outwardly and inwardly. It could be oriented at different angles. The bearing wall could be replaced with other means, or placed in a different location.

It will be understood that the face frame 12 may be used in various orientations. Reference herein to "upper" and "lower" etc., in connection to portions of the structure are merely for convenience in understanding the drawings, and do not in any way limit or restrict the scope of the invention. Thus the side members 12*a, b, c, d*, are used both perpendicularly and horizontally in the example shown, and the description is related, in the example, to top member for convenience only.

While the outer walls and inner channel walls are formed in spaced location, in this example, they could of course be simply opposite sides or surfaces of a solid integral member, if desired. The angular configuration of the inner channel walls could also be subject to alteration, and could conceivably be parallel to either of the outer walls if desired.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A face frame for a flexible sign panel the frame having four side members arranged in a generally rectangular shape said frame defining a front and a rear, and inner and outer frame portions, each side member comprising;

frame walls forming a partial enclosure;

channel walls located within the enclosure provided by said frame walls defining a channel having an axis directed with a vector lying from the rear to the front of said frame and a channel opening on the rearward end of said axis;

tension bearing means adjacent said channel opening on one side thereof;

shoulder means adjacent the other side of said channel opening;

clamp means adapted to grip the edge of said flexible sign panel, said clamp means being dimensioned to be slidable within said channel walls so that said clamp means may be slid into and out of said channel walls, and, threaded adjustment means extending from said tension bearing means, and adapted to engage a portion of said clamp means, adjustment of said threaded adjustment means forcing said clamp means into said channel walls, whereby to tension said flexible sign panel around said shoulder.

2. A face frame as claimed in claim 1 wherein said frame walls include a pair of generally planar walls meeting at a corner and forming an L-shaped angle, forming a partial enclosure, and wherein said channel walls are located in said partial enclosure, and are directed along an axis towards the apex of such frame walls.

3. A face frame as claimed in claim 2 wherein one of said channel walls has a generally concave curvature, and wherein the other of said channel walls is generally planar.

4. A face frame as claimed in claim 3 wherein said tension bearing means is connected to said generally curved channel wall, and extends partially across the spacing between said curved channel wall and said planar channel wall.

5. A face frame as claimed in claim 4 wherein said threaded adjustment means comprise a plurality of threaded rod members, received in threaded openings in said bearing means at spaced apart intervals therealong, and being extendible and retractable with respect to said channel walls.

6. A face frame as claimed in claim 1 wherein said clamp means comprises an elongated bar member, a channel formed along said bar member and defining an open mouth, said open mouth being restricted with respect to said channel, and rod means insertable in said channel, whereby a portion of said panel may be passed around said rod means and clamped in said open mouth of said channel.

7. A face frame as claimed in claim 6 wherein said bar member further defines a body portion having a planar surface, for contacting said panel.

8. A face frame as claimed in claim 7 wherein said bar member further defines groove means adapted to receive a portion of said threaded adjustment means.

9. A face frame as claimed in claim 1 including hinge formations formed on said face frame, for interengaging with complementary hinge formations on a support structure.

10. A face frame as claimed in claim 1 wherein said channel walls define a channel located on an axis angled to said frame walls and extending from an outer, front end to an inner, rearward end, with said channel opening at said inner rearward end.

11. A face frame as claimed in claim 10 wherein said frame walls include a pair of walls meeting at a corner and wherein said channel walls define front and rear channel walls, said front channel wall being connected to said shoulder means, and said shoulder means being connected to one of said frame walls, and said tension bearing means connected to said rear channel wall.

* * * * *